United States Patent [19]

Lalli

[11] 4,258,914

[45] Mar. 31, 1981

[54] ISOKINESTHETIC DEVICE

[76] Inventor: Ronald P. Lalli, 515 Forest Hills Rd., Springfield, Mass. 01128

[21] Appl. No.: 107,061

[22] Filed: Dec. 26, 1979

[51] Int. Cl.[3] ..... A63B 21/18

[52] U.S. Cl. ..... 272/71; 224/219; 272/119; 224/241; 434/254

[58] Field of Search ..... 272/71, 67, 96, 94, 272/119, 125, 143, DIG. 4; 273/DIG. 17, DIG. 18, DIG. 19, 54 B, 54 BA, 189 R, 189 A; 35/29 B; 63/1 R; 224/164, 165, 219, 220, 221, 222, 241, 240, 235

[56] References Cited

U.S. PATENT DOCUMENTS

| | | | |
|---|---|---|---|
| 334,844 | 1/1886 | Briesen | 224/221 |
| 1,573,239 | 2/1926 | Gilliland | 224/219 X |
| 1,729,209 | 9/1929 | Curtice | 272/119 |
| 2,241,833 | 5/1941 | Waller | 272/96 X |
| 2,255,999 | 9/1941 | Kuehner | 224/219 X |
| 2,449,324 | 9/1948 | Robinson | 224/235 X |
| 3,202,331 | 8/1965 | McKinstrie | 224/221 |
| 3,490,766 | 1/1970 | Gardner | 272/67 X |
| 3,588,105 | 6/1971 | Donohoe | 272/119 X |
| 3,924,851 | 12/1975 | Winston | 272/119 X |
| 4,027,666 | 6/1977 | Marx | 273/189 R X |
| 4,113,157 | 9/1978 | Woodbury | 224/240 X |

FOREIGN PATENT DOCUMENTS

| | | | |
|---|---|---|---|
| 720201 | 12/1931 | France | 272/96 |
| 95251 | 6/1922 | Switzerland | 224/241 |
| 572 | of 1890 | United Kingdom | 272/96 |

*Primary Examiner*—Richard C. Pinkham
*Assistant Examiner*—Arnold W. Kramer
*Attorney, Agent, or Firm*—Ross, Ross & Flavin

[57] ABSTRACT

A training device for competitive swimmers which can be adjustably mounted on a swimmer's body part and, in operational use, provides predetermined resistances of varying degrees to the swimmer's normal movements, causing him to exert greater effort, the resistances being generated by weights selectively and removably mounted within the device. Exploitation is made of the muscle as a sensory organ in generating a heightened awareness of muscle or tendon or joint movement.

1 Claim, 13 Drawing Figures

ISOKINESTHETIC DEVICE

The invention relates to an isokinesthetic device effective in the development and improvement of the movements of a swimmer, particularly one engaging in competitions, and as such may be classified as a training device. It makes use of muscular exercises as part of a swimmer-in-training and enables him to learn, through a combination of weight and conscious sensory movement, how effectively to swim through the water by developing optimum muscular force, that is by placing his limbs in the best possible positions at all moments during the course of a swimming procedure.

The invention comprises a weight-containing housing strappable upon a body limb during in-water isokinesthetic training for purposes of proprioception, the term "isokinesthetic" being understood to stand for the exploitation of a muscle as a sensory organ in generating a heighthened awareness of muscle or tendon or joint movement. This awareness emanates from a muscle contraction against a constant force throughout a range of muscle or tendon or joint movement.

Stated otherwise, and for the purposes hereof, isokinesthetics is defined as the science of developing a mere acute awareness or perception, taking into full account the fact that the slightest variance of differential in weight has a capacity to heighten sensory perception with respect to position.

The swimmer desirably must learn just how much muscular action is necessary to move himself through the water, a sense which, if properly developed, will help him to succeed in competition. This sense has to do with the awareness of perception of the optimum positions and movements of the body parts as derived from the feelings of the muscles, tendons, and joints as they assume their different operating positions. It is sense development to which this invention is specifically directed.

The device, useful not only in the daily in-water workout but also in the pre-event tuneup, aids in the creation of a heightened sensory awareness and sets the stage for a high quality sensory performance.

With the device in operating position, the swimmer executes his usual stroking movements, concentrating on the position and direction of his hands or feet, as the case may be, and in the process experiences this heightened degree of sensation or sense.

Its use serves to reverse the sensory deprivation caused by the anti-gravity effect of submersion in water. With the augmentation of the weights at the wrists or the ankles, proprioceptors are fired due to the development of this heightened awareness.

The invention essentially provides the swimmer with a distinct sense of the muscular action necessary for his self-propellation through the water, a sense which helps him to increase his competitive capacity in the areas of strength, endurance and speed.

Success in sporting events is dependent in great degree upon acceleration and velocity, power or strength considerations alone not being enough. In particular, the swimmer has to create kinetic energy in order to move efficiently and rapidly through the water. In the fundamental equation for kinetic energy, $K=MV^2$, it is implicit that, in the swimmer's case, the only variable is velocity. Assuming that the usual swimming movements can be performed with an average degree of strength, hand speed assumes an increased importance in the case of each of the different strokes.

Additionally, the complicated nature of the swimming technique mandates a special kind of learning process, such skill-learning being made easier by virtue of the stimulus received in the form of heightened sensations. Thus, this invention.

Perhaps it may be best decribed in terms of what it is not designed to accomplish. It is not intended to provide a form after-effect, in the sense, as the term may be defined, of the sensation usually emanating from the use of heavier-than-normal objects, such as weighted vests, weighted shoes or the like. For a long time, expectations of improved performance were assumed to be gained, once a particular weight load was removed, a benefit not necessarily true, as recent studies have proven.

While admittedly a weight system is herein involved, it is nonetheless of a sophisticated type and one readily distinguishable from the common and conventional weight-in training approaches. The system hereof keys the swimmer to a think sensation in the sense that it helps to arrest undue fatigue at the end of a swimming event. An easy beginning spells sensory orientation at the end, thereby avoiding an over-muscled performance.

An excess of muscular contraction produces excess lactic acid and other metabolic by-products. At the same time, the increased tension strangles its own blood supply. Any emphasis on sensation leads to an improved blood supply through a reduced muscle tension.

Use of the invention in training leads to improved energy economy in actual swimming events because such require rapid sequential movements. It also provides a bio-feedback in the form of muscle or tendon or joint sensations without distorting the skin-water interface by allowing the hands to be free to assimilate a tactile discriminatory sense.

Weight training through the use of such as wall pulleys and an inclined bench and like equipment ws believed to allow the swimmer to practice while in the swimming position. Such weight training was called isotonic, meaning muscular movement through a full range of movements. Its evolution has seen a great number and variety of instruments making use of isotonic muscular movements. Cases are known where, even today, swimmers use such equipment in training, the very same equipment in some cases as used by weight lifters in their training programs.

Another training technique for swimmers has been one involving the overload principle, i.e., working with more weight at all times. Not only are weights used for such overloading, but also swimmers may use web gloves, hand paddles and even the so-called doughnut, a spongy material of ringlike configuration which absorbs water creating its own degree of drag. Each such method doubtlessly improves strength, and likely has a beneficial effect on performance. But they, at the same time, each offer at least one major drawback; they each introduce unnatural sensations which the swimmer, knowingly or otherwise, has to overcompensate for. As an example, a flat will disturb the natural interface sensation between the hand and water upon entry. The swimmer has to compensate for the reflection forces introduced by the artificial broad surfaces represented by the paddles or gloves. Too, when such paddles or gloves are removed, the pattern of nerve impulses obviously must be changed back to the normal sensation of hand against water.

Reduced to simplest terms, it can be stated that there is an inconsistency when compared with normal stroking movements, an inconsistency which detracts from the important desideratum of developing proper stroke technique.

Since weight training has been used as a means of developing strength in athletes, the technique has been much overused and misused. So many athletes are, in effect, training as Olympic weight lifters when, in fact, nearly all sports demand a rotation of the torso, a function for which weight training is essentially useless. Thus, athletes are wasting their time and energy building great strength where it is not needed. What is more, rotationless weight training does not improve motion performance. Nor does it help prevent muscle strains of the lower back, low back pain, dropped shoulder and scapulocostal syndromes in hitting athletes, and reduced ankle flexibility and Achilles tendinitis in runners.

This is not an argument for discarding weight training in its entirety. Rather it is a statement that it is inappropriate in much of athletic training and, in the case of swimming at least, it can be and should be supplanted or enchanced by other more specific training techniques.

The real significance of body awareness is the key in this invention. With proper analysis of stroke mechanics, and with isolated sensations via the light weights located on the wrists or on the ankles, the swimmer is enabled to feel or sense where the arms or feet are or should be so as to lead properly to each optimum stroke movement. The swimmer being in a state of buoyancy, the placement of the weights on the body limbs allows him to become more acutely aware of the sensation which leads to an ability to be more discriminating in the matter of the best positions for the arms or legs in all phases of his stroke. This ability to isolate the sensation gives himself the ability to correct his own stroke deficiencies.

The area of consciousness, as it relates to awareness of movement, it something needing to be better understood by coaches and athletes alike. The more refined the athlete's movements become, the greater the opportunity to improve the techniques resulting in more successful performance in actual competition.

Isokinesthetics of this kind will assist the swimmer in developing more quickly pattern of movement essential for a more successful performance under actual conditions of competition.

Accordingly, the primary object of this invention may be defined as a device to be attached to the body of the swimmer to give him a greater awareness of his body parts as he moves through the water.

A secondary object is to provide to the swimmer, as he moves through the water in practice sessions, distinct sense of the muscular action necessary in his self-propellation, a sense which helps him to increase his competitive capacity in the areas of strength, endurance and speed.

Another object is to provide a device adapted to be placed on an ankle or wrist during swimming practice for purposes of building an improved awareness on the part of the swimmer and, in the process, of improving his stroke technique.

Figure 1:
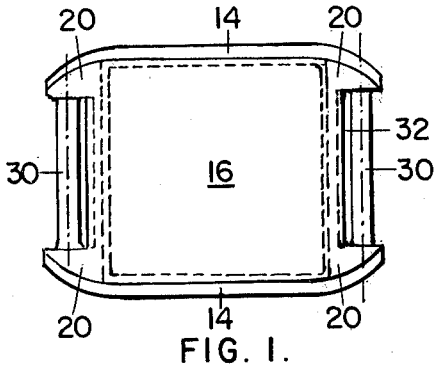
FIG. 1 is a view in top plan view of one species of the device of the invention.
Figure 2:
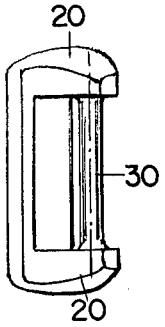
FIG. 2 is a view in end elevation of the FIG. 1 device.
Figure 3:
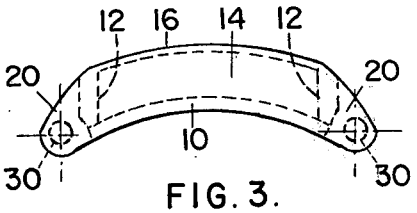
FIG. 3 is a view in side elevation of the FIG. 1 device.
Figure 4:
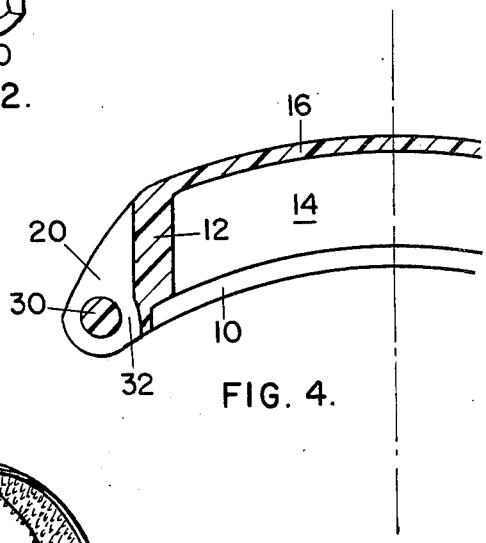
FIG. 4 is an enlarged fragmentary sectional view of the FIG. 1 device.

One form of construction as illustrated in FIGS. 1–6 in the drawings, comprises a closure or wall member 10, preferentially of plastic and having a generally arcuate configuration adapted to conform generally to the dorsal of the wrist or ankle of a swimmer.

Secured thereto as by a snug friction fit is a boxlike body member comprised of upstanding opposite end walls 12 and 12 and opposite side walls 14 and 14 interconnected in usual boxlike manner by a top wall 16 having an arcuate configuration corresponding to the configuration of closure member 10 so as to contribute to the esthetic appeal of the assembled device.

Extending outwardly from each end wall 12 from and generally in the plane of a respective side wall 14 is a pair of ears 20, 20, each ear being slightly rounded inwardly at its terminus so that the two ears extending outwardly from one end wall 12 appear to converge slightly toward each other, as best observed in the top plan view of FIG. 1, again for purposes of esthetic appeal. Connecting between each set of ears at each end is a pin 30 extendable between the respective ears of the set and nestably receivable in strategically aligned openings in the opposite ears. Each pin is suitably spced from its respective end wall to define a slot 32 therebetween.

The construction is so structured that closure member 10 may be conveniently pried from the body member for purposes of allowing entry to the interior space therewithin, in which space one or more weight 40, each having a complemental arcuate configuration, may be conveniently received in a stacked relationship.

The employment of one or more of the weights will depend upon the state of the training of the individual swimmer.

Figure 5:
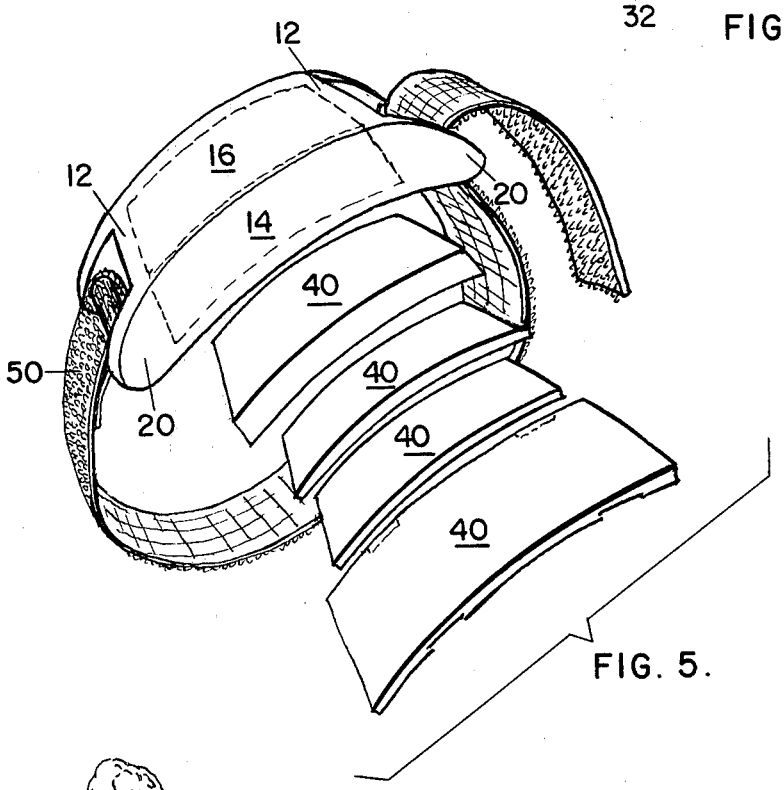
FIG. 5 is an exploded isometric view of the FIG. 1 device.

A strap 50 of a hook and loop fastening material may be interengaged around one of the pins in looped relationship, the leftward one as viewed in FIG. 5, so as to allow the free end to be looped around the other pin and through the other slot, the rightward one as viewed in FIG. 5. By this means, the strap may be so adjusted as to be snugly receivable around the wrist or ankle of any swimmer.

Figure 6:
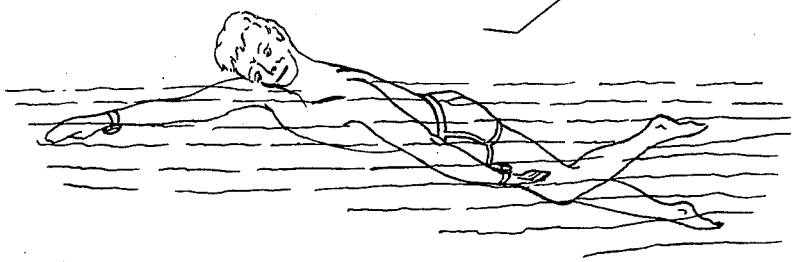
FIG. 6 is a view showing a swimmer using the device while swimming.

In FIG. 6, there is illustrated a swimmer wearing a device of the invention on ech of this wrists.

In FIGS. 7-10, I have exemplified another species of the invention a closure or wall member 110, having a generally arcuate configuration adapted to conform generally to the dorsal of the wrist or ankle of a swimmer and hingedly connected at one side edge 111 to a boxlike body member comprised of upstanding opposite end walls 112 and 112 and opposite side walls 114 and 114 interconnected in usual boxlike manner by a top wall 116 having an arcuate configuration corresponding to the configuration of closure member 110.

Figure 7:
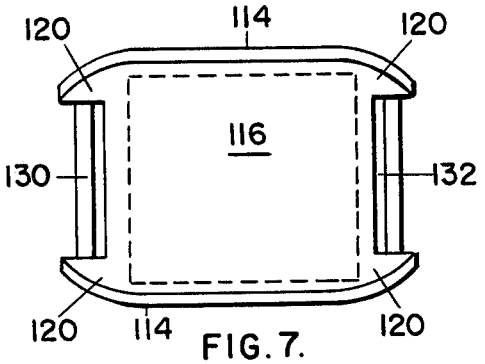
FIG. 7 is a view in top plan of another species of the device of the invention.
Figure 8:
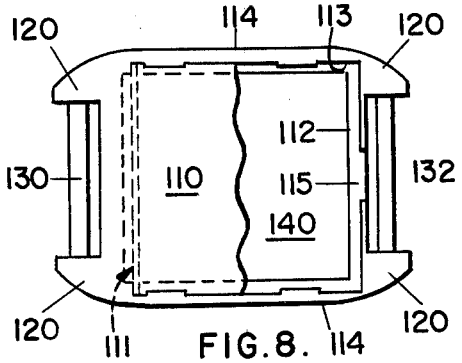
FIG. 8 is a bottom plan view of the FIG. 7 device with the inner structure removed and with the cover plate shown fragmentarily and in the cover opened position.
Figure 9:
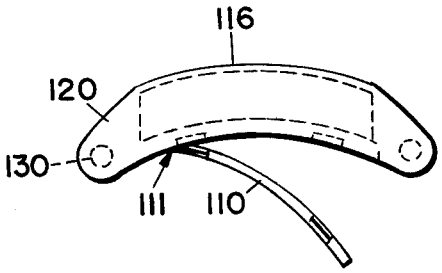
FIG. 9 is a side elevational view of the FIG. 8 device.
Figure 10:
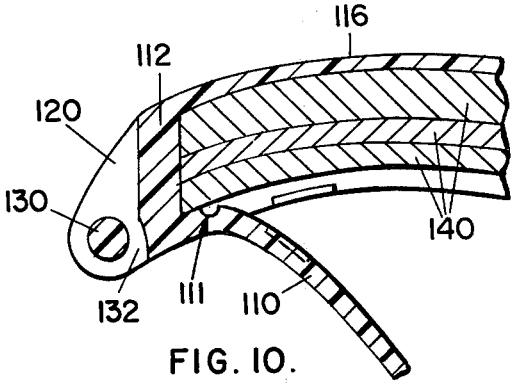
FIG. 10 is an enlarged fragmentary sectional view of the FIG. 7 device showing the inner structure in position.

Extending outwardly beyond each end wall 112 from and generally in the plane of a respective side wall 114 is a pair of ears 120 and 120, each ear being slightly rounded inwardly from one end wall 112 will appear to converge slightly toward each other, as best observed in FIG. 7.

Connecting between each set of ears at each end is a pin 130 extendable between the rspective ears of the set and nestably receivable in strategically aligned openings in the opposite ears, with each pin being suitably spaced from its respective end wall to define a slot 132 therebetween.

The body and closure may be integrally formed and the closure will be so configured as to be nestably receivable as by a friction fit within a provided recess 113 having seating ledge 115 on which the closure may bottom when in the closed position.

The closure may be conveniently pried away from the body for purposes of allowing entry to the interior space therewithin, in which space one or more weights 140, each having a complemental arcuate configuration, may be conveniently received.

A strap of Velcro or the like (not shown) may be interengaged around one of the pins 130 so as to allow the free end to be looped through the other slot, so that the strap may be so adjusted as to be snugly receivable around the wrist or ankle of any swimmer.

With reference to the weighting means employed, a few words are indicated.

To determine the amount of work performed by a swimmer using the training aid of the invention, a realistic approximation of an average swimmer is used. An involved mathematical analysis model would have been impractical since the dynamic forces involved are different for each swimmer.

For practical purposes, let it be assumed that the "average" swimmer has an arm length of 1.5 feet and will use 22 strokes in swimming 25 yards, meaning 11 strokes per arm.

Using these figures, the swimmer is calculated to perform the following work during each 1000 yards of swimming for each 1 oz. of weight used:

1 oz.=0.0625 lbs.×1.5 ft.−0.0938 ft.-lbs.×22 strokes−2.063 ft.-lbs./pool length×40 lengths (1000 yds.)=82.5 ft.-lbs./1000 yds.

Using this method, the following workload table shows the amount of work, given in total pounds, for a range of weight values and swimming distances:

| Distance | Total Weight in Lbs. For | | | |
|---|---|---|---|---|
| In Yards | 1 oz. | 2 oz. | 3 oz. | 4 oz. |
| 1,000 | 83 | 165 | 248 | 330 |
| 2,000 | 165 | 330 | 495 | 660 |
| 3,000 | 248 | 495 | 743 | 990 |
| 4,000 | 330 | 660 | 990 | 1,320 |
| 5,000 | 413 | 825 | 1,238 | 1,650 |
| 6,000 | 495 | 990 | 1,485 | 1,980 |

-continued

| Distance | Total Weight in Lbs. For | | | |
|---|---|---|---|---|
| In Yards | 1 oz. | 2 oz. | 3 oz. | 4 oz. |
| 7,000 | 578 | 1,155 | 1,733 | 2,310 |
| 8,000 | 660 | 1,320 | 1,980 | 2,640 |
| 9,000 | 743 | 1,485 | 2,228 | 2,970 |
| 10,000 | 825 | 1,650 | 2,475 | 3,300 |
| 12,000 | 990 | 1,980 | 2,970 | 3,960 |
| 14,000 | 1,155 | 2,310 | 3,465 | 4,620 |
| 16,000 | 1,320 | 2,640 | 3,960 | 5,280 |
| 18,000 | 1,485 | 2,970 | 4,455 | 5,940 |
| 20,000 | 1,650 | 3,300 | 4,950 | 6,600 |

To determine the amount of work done by each arm, the "total weight in pounds" calculation need only be divided by "2."

Figure 11:
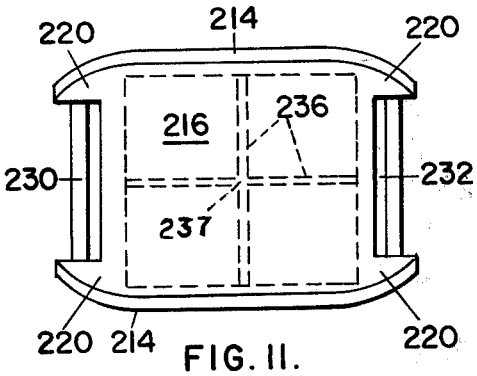
FIG. 11 is a top plan view of still another species of the device of the invention.
Figure 12:
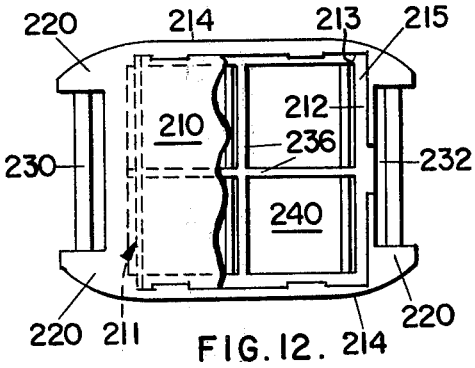
FIG. 12 is a bottom plan view of the FIG. 11 device with the inner structure in situ and with the cover plate shown fragmentarily and in the cover opened position.
Figure 13:
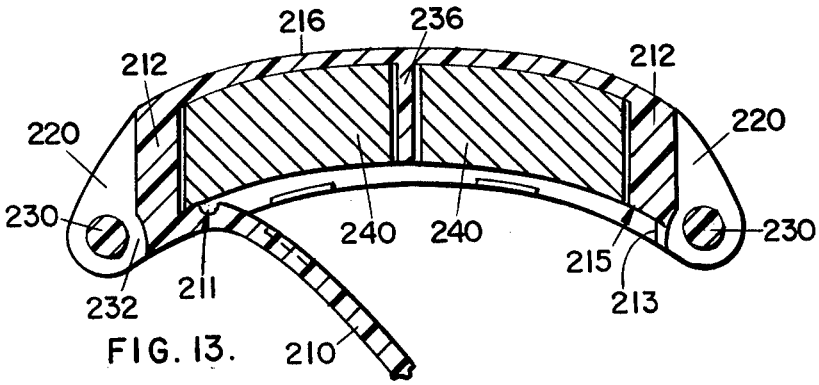
FIG. 13 is an enlarged sectional view of the FIG. 12 device.

In FIGS. 11-13, I have exemplified still another species of the invention, a closure or wall member 210 having a generally arcuate configuration for conformity generally with the dorsal of the wrist or ankle of a swimmer and hingedly connected at one of its side edges 211 to a boxlike body member comprised of upstanding opposite end walls 212 and 212 and opposite side walls 214 and 214 interconnected in usual boxlike manner by a top wall 216 having an arcuate configuration corresponding to the configuration of closure member 210.

Extending outwardly from each end wall 212 from and generally in the plane of a respective side wall 214 is a pair of ears 220 and 220, each ear being slightly rounded inwardly at its ternimus.

Connecting between each set of ears at each end is a pin 230 extendable between the respective ears of the set and nestably receivable in strategically aligned openings in the opposite ears, with each pin being suitably spaced from its respective end wall to define a slot 232 therebetween.

The body and closure may be integrally formed and the closure will be so configured as to be nestably receivable as by a friction fit within a provided recess 213 having a seating ledge 215 on which the closure may bottom when in the closed position.

The closure may be conveniently pried away from the body for purposes of allowing entry to the interior space therewithin.

within the interior space, a pair of partition walls 236, and 236 extendable in planes normal to each other and conceivably joined to each other at their point of intersection 237 are disposed, they each being of a suitable length so as to extend to a respective interior side wall of the body, thereby defining a quartet of quadrants, into each of which quadrants one or more weights 240 may be selectively disposed.

I claim:

1. A swimmer's training aid for application to a swimmer's lower arm or leg to provide an increased awareness of propulsion effect comprising:

a body element securable to the swimmer's body and defining an interior pocket having interior side walls and having an arcuate configuration conforming to a swimmer's torso;

a pair of partition walls within the interior pocket extendable in planes normal to each other, each being of a suitable length so as to extend to a respective interior side wall of the body for defining a quartet of quadrants;

a closure interengageable with the body element for enclosing the pocket;

a plurality of weights selectively receivable in nesting relationship within the pocket in the quartet of quadrants; and means for slidably and adjustably supporting the body on the arm or leg of the user.

* * * * *